United States Patent [19]

Hwang

[11] Patent Number: 5,047,145

[45] Date of Patent: Sep. 10, 1991

[54] WET PROCESS FOR FLY ASH BENEFICIATION

[75] Inventor: Jiann-Yang Hwang, Houghton, Mich.

[73] Assignee: Board of Control of Michigan Technological University, Houghton, Mich.

[21] Appl. No.: 528,817

[22] Filed: May 24, 1990

[51] Int. Cl.[5] ..... B03B 5/30; B03B 9/04; B03B 1/02

[52] U.S. Cl. ..... 209/166; 209/12; 209/39; 209/173; 106/405

[58] Field of Search ..... 209/164, 166, 167, 39, 209/12, 173, 3, 10; 106/405

[56] References Cited

U.S. PATENT DOCUMENTS

| | | | |
|---|---|---|---|
| Re. 31,540 | 3/1984 | Aldrich | |
| 2,352,324 | 6/1944 | Hubler | |
| 2,713,420 | 7/1955 | Lord | 209/166 |
| 2,835,384 | 5/1958 | Tromp | |
| 2,987,408 | 6/1961 | Minnick | |
| 3,023,893 | 3/1962 | Zaborowski | |
| 3,086,718 | 4/1963 | Lukas, Jr. | |
| 3,533,819 | 10/1970 | Pennachetti | |
| 3,769,054 | 10/1973 | Pennachetti | 209/12 |
| 3,794,250 | 2/1974 | Brewer | |
| 3,830,776 | 8/1974 | Carlson | 106/405 |
| 4,121,945 | 10/1978 | Hurst et al. | 209/166 |
| 4,191,336 | 3/1980 | Brown | 209/39 |
| 4,426,282 | 1/1984 | Aunsholt | 209/167 |
| 4,652,433 | 3/1987 | Ashworth et al. | 209/164 |

FOREIGN PATENT DOCUMENTS

| | | | |
|---|---|---|---|
| 1167574 | 5/1984 | Canada | 209/166 |
| 310539 | 10/1987 | European Pat. Off. | 209/164 |
| 1176952 | 9/1985 | U.S.S.R. | 209/166 |

*Primary Examiner*—Stanley S. Silverman
*Assistant Examiner*—Thomas M. Lithgow
*Attorney, Agent, or Firm*—Dinnin & Dunn

[57] ABSTRACT

A wet process for the beneficiation of a fly ash by-product has the following steps: a) forming a slurry mixture of a fly ash material and a liquid; b) gravitationally separating and collecting a first material fraction of the fly ash having a density less than the liquid by skimming off floating slurry material; c) separating a first magnetic fraction from the slurry by subjecting the slurry to a magnetic field of from about 300 gauss to about 10 kilogauss; d) separating the unburned carbon from the remaining slurry components by adding an effective amount of an oil having a carbon chain greater than octane, and a frothing agent whereby the oil coats the unburned carbon forming hydrophobic carbon materials and inducing air into the system for frothing the slurry mixture wherein the hydrophobic unburned carbon froths to the surface and is removed by skimming off the frothing layer; and e) collecting the remaining fraction of silicate spheres and silicates.

20 Claims, No Drawings

WET PROCESS FOR FLY ASH BENEFICIATION

BACKGROUND OF THE INVENTION

1. Field of the Invention

The present invention relates to a process for the beneficiation of fly ash in order to produce increased value components therefrom.

2. Description of Related Art

Disposal of fly ash from coal fired electrical power plants and the like has become increasingly a problem. The annual fly ash production in the United States is more than fifty million tons of fly ash. At the present time, about eighty percent of the fly ash produced is disposed as waste. The disposal cost for this waste ranges anywhere from ten dollars a ton to fifty dollars a ton at the present time and is extremely expensive in light of the large quantities disposed by these power plants.

Some of the fly ash by-product is recycled in its raw form for use as fillers for roadway shoulders and asphalt pavement and the like. It is also known that fly ash contains several beneficial products such as unburned carbons, cenospheres, iron rich spheres, iron silicate spheres and other silicates all of which have beneficial uses if proper separation can be obtained to acquire these products in a pure enough form. For instance, the silicate spheres may be used as a pozzolan composition in a cementatious material and the unburned carbons can be easily converted into activated carbon which is a highly profitable by-product of fly ash waste.

In the past, several dry type beneficiation processes have been attempted in order to remove and separate various useable products of the fly ash. However, these processes have generally not allowed adequate separation between the various fractions of the fly ash and therefore the processes and resulting products have not been particularly marketable or cost effective overall.

Wet beneficiation processes have also been attempted in the past, however, these processes have also not been commercially practicable to adequately separate the desired fly ash components.

SUMMARY OF THE INVENTION

In accordance with the present invention there is provided a wet process for fly ash beneficiation which includes the following steps. First, a slurry mixture is formed by mixing a fly ash material and a liquid such as water. A first material fraction is collected from the slurry by gravitationally separating the first material fraction which has a density less than the water. This is done by skimming off any material floating after gravitational separation. Thereafter, a first magnetic fraction is selectively separated from the slurry by subjecting the slurry to a magnetic field of from about 300 gauss to about 10 kilogauss. Thereafter, the unburned carbon is separated from the remaining slurry components. The unburned carbon separation is accomplished by adding an effective amount of an oil having a carbon chain greater than octane and a dispersant and frothing agent to the slurry. The oil coats the unburned carbon, forming hydrophobic unburned carbon particles. Thereafter, air is introduced into the system for frothing the slurry mixture wherein the hydrophobic unburned carbon froths to the surface and is removed by skimming off the froth layer. The remaining fraction is a mixture of silicate spheres and silicates which may be collected by conventional filtering of the slurry.

Other advantages of the present invention will be readily appreciated as same becomes better understood by reference to the following description and example.

DESCRIPTION OF THE PREFERRED EMBODIMENT

Generally, the present invention involves the steps of: a) forming a slurry mixture of a fly ash material and a liquid; b) gravitationally separating and collecting a first material fraction of the fly ash having a density less than the liquid by skimming off floating slurry material; c) separating a first magnetic fraction from the slurry by subjecting the slurry to a magnetic field of from about 300 gauss to about 10 kilogauss; d) separating the unburned carbon from the remaining slurry components by adding an effective amount of an oil having a carbon chain greater than octane, and a frothing agent whereby the oil coats the unburned carbon forming hydrophobic carbon materials and inducing air into the system for frothing the slurry mixture wherein the hydrophobic unburned carbon froths to the surface and is removed by skimming off the frothing layer; and e) collecting the remaining fraction of silicate spheres and silicates.

In accordance with the first step of the present invention the fly ash material is mixed with a liquid of a preselected density. Water is a preferred liquid utilized to form a slurry mixture. Generally, a slurry may be formed with from about 5% to about 35% by weight fly ash, however, preferably 10% to 30% by weight fly ash with the remaining water is utilized in the slurry formed in the present invention. Depending on the particular fly ash material the quantity of fly ash may vary and also the ability of the fly ash to form a slurry in the water may vary. Thus, in a preferred embodiment of the present invention a dispersant is added to the solution for better incorporation of the fly ash into the slurry in the water. Suitable dispersants include silicates, phosphates, polyacrylic acids, ligno sulphonates and mixtures thereof. A preferred dispersant is sodium silicate or sodium tripolyphosphate and the mixture of same. The dispersant is generally used in the range of from about 0.01 to about 30 pounds per ton of fly ash in the slurry, typically from about 0.01 to about 4 pounds and preferably from about 0.2 to about 2 pounds of dispersant per ton of fly ash is used.

In the second step of the present invention, a material fraction is gravitationally separated from the slurry mixture. This may be accomplished by merely allowing the slurry mixture to settle over a period of about two minutes or more if necessary. In a preferred embodiment of the present invention the solution is first allowed to settle for about two minutes and thereafter the fraction of the fly ash material floating on the surface is skimmed off and filtered thereby collecting the fraction of the fly ash which is less than the density of water or less than about 1.0 grams per cubic centimeter. If desired, this step may be accentuated by centrifuging the slurry further and thereafter removing the liquid layer and filtering it to remove any remaining material which may be floating in the water. This step of the present invention includes the collection of a relatively pure cenosphere product.

Alternatively, if it is desired to separate the cenosphere fraction into different density classifications, the density of the water may be adjusted initially by addition of a density adjusting constituent or the initial separation from the water may be accomplished and thereafter the remaining slurry components may be subjected to a higher density solution to separate a second fraction of the cenospheres as explained subsequently. A second fraction may be removed of a different density cenosphere material by the addition of a density increasing substance to the slurry mixture. In this alternative step of the present invention it is a selective separation of fly ash material contained in the fly ash which has a density in the range of from about 1 gram per cubic centimeter to about 1.6 grams per cubic centimeter and may be removed from the mixture. This is accomplished by the addition of a water soluble material such as an alkali halide or sulfate salt. Particularly preferred for this step are the salts of iodides and bromides such as potassium iodide or cesium bromide. However, other water density increasing substances could be used, depending on the final use of the cenosphere product, such as ferric sulphate, sulfuric acid and others as are known to those skilled in the art. The salts may be added to the solution to produce a solution having a density in the range of generally from about 1.0 to 1.6, typically from about 1.2 to 1.5 and preferably from about 1.3 to 1.4, which can be calculated using known calculations such that cenosphere materials in the 1.0 gram per cubic centimeter to 1.6 gram per cubic centimeter range will float in the solution and may be thereafter collected from the upper layers of the slurry and removed for later beneficial use.

In accordance with the third step of the present invention a magnetic fraction of the fly ash material is removed by processing the remaining slurry in a magnetic separator, such as an Eriez Magnetics Low Intensity Drum Separator. Generally, fly ash materials contain some highly magnetic and some weakly magnetic particles. The highly magnetic particles include iron oxide rich spheres and the weakly magnetic materials include iron silicate spheres and the like. The entire magnetic fraction, which includes the highly magnetic and weakly magnetic materials may be removed from the slurry by utilizing a magnetic field of from about 1 to about 10 kilogauss in the magnetic separator. However, if only the highly magnetic materials are desired to be removed from the system the slurry material may be subjected to a magnetic field of from about 100 to about 500 and typically from about 200 to 400 and preferably from about 250 to 350 gauss. In a preferred embodiment of the present invention the magnetic separation step is a two step process wherein a wet high intensity magnetic separator or the like may be used to generate a high intensity magnetic field of from about 1 to about 10 kilogauss for removing all highly magnetic and weakly magnetic materials from the slurry mixture and thereafter the highly magnetic materials may be removed by employing the lower range magnetic fields set forth above.

This material is also collected and utilized for commercial purposes such as pigments, heavy media, iron metal, electromagnetic shields in the case of iron oxides or a cement raw material in the case of iron silicates.

The remaining components in the slurry mixture, after the above separation steps, include a substantial amount of unburned carbon, silicate spheres and other silicate particles which had not been separated by the above steps. In the fourth step of the present invention the unburned carbon is selectively removed from the remaining components of the slurry. In accordance with this step an effective amount of a collector such as an oil or other material, which is compatible for forming hydrophobic carbon particles out of the unburned carbon is interposed in the system. Additionally, it is preferred that a frothing agent is added at this time to accomplish the removal of the unburned carbon. The hydrophobic forming material is generally an oil having a carbon chain greater than octane. To provide flotation conditions for the unburned carbon there must be selective attachments of hydrophobic carbon particles to air bubbles in a slurry. Suitable oils which act as a collector for these carbon particles include kerosene, fuel oil and other heavy oils such as linseed oils. Frothers which may be utilized in the present invention include low molecular weight alcohols having from about 3 to 8 carbon atoms, polyglycols such as Dowfroth® 250, pine oil and methyl isobutyl carbinol. Additionally, it may be advantageous to include a dispersant, such as those listed above, to the solution to ensure that silicate particles are not agglomerated with unburned carbons.

It may be desirable to ensure that a dispersant is also in the solution at this step. The dispersants utilized are typically those remaining in the slurry from the earlier addition. Frothing agents may be added as necessary for frothing to occur and is not critical in the present invention. However, the collector constituent is critical in that a sufficient amount must be added to collect the carbon particles in the solution. Depending on the beginning fly ash material the amount of collector utilized is generally from about 0.5 to about 10 pounds per ton of fly ash, typically from about 0.5 to 5 pounds per ton and preferably from about 1 to 4 pounds per ton.

Thereafter, using conventional techniques, an air stream is imposed into the solution which produces a frothy layer containing hydrophobic unburned carbon particles. This frothy layer is collected and the unburned carbon may be purified by evaporation of the oils and other chemicals and thereafter used for various purposes such as producing activated carbon. The frothing step may be carried out in a Denver or Wemco flotation apparatus or a column flotation apparatus or the like. The carbon may be used or sold for purposes of making activated carbon.

After the above fractions are removed the remaining material is a purified fly ash product which is high in silicate content which may be dried and advantageously utilized in concrete, as road base, as a filler and as a pozzolanic material.

Further understanding of the present invention will be had from the following example.

EXAMPLE I

An example of a wet beneficiation process performed in accordance with the teachings of the present invention is described subsequently. About 660 g of a fly ash material, which was obtained from Michigan Ash Sales Company, was added to water to make a 2200 ml slurry. Sodium silicate (0.66 g) and sodium tripolyphosphate (0.33 g) were added as the dispersing reagents. The pH of the slurry was about 8.2. After 2 minutes of mixing and 2 minutes of settling, the materials floating on top of the slurry were skimmed off, filtered and dried. This material had a weight of 1.12 g and an average density of 0.756 g/cm$^3$. The particle size was primarily in the range of 20 to 150 micrometers diameter with an average of 70 micrometers. Chemical compositions were: 55.54% $SiO_2$, 1.08% $TiO_2$, 29.74% $Al_2O_3$, 0.01% $Cr_2O_3$, 3.86% $Fe_2O_3$, 0.41% CaO, 1.52% MgO, 0.02% MnO, 0.40% $Na_2O$, 4.08% $K_2O$, 0.03% S, 0.17% $P_2O_5$, and 1.60% Loss of Ignition. One third of the slurry was then syphoned from the top to collect other low density materials. The syphoned slurry was filtered and the filtrate was returned to the original slurry. The filter cake was then immersed in a heavy liquid having a specific gravity of 1.27 (using potassium iodide solution). After 15 minutes of centrifuging, the materials floating on the heavy liquid were collected, filtered, washed, dried, and weighed (11.55 g). The sink fraction weighed 14.52 g.

The slurry was mixed again and passed through a high intensity magnetic separator at 5 kilogauss. The collected magnetic material was then passed through a low intensity magnetic separator operating at 300 gauss. This magnetic fraction weighed 22.44 g. The average particle size was 13 micrometers with 95% smaller than 40 micrometers. Chemical compositions were: 38.84% $SiO_2$, 1.12% $TiO_2$, 21.91% $Al_2O_3$, 0.04% $Cr_2O_3$, 29.53% $Fe_2O_3$, 1.24% CaO, 1.29% MgO, 0.14% MnO, 0.27% $Na_2O$, 1.88% $K_2O$, 0.04% S, 0.29% $P_2O_5$, and 3.00% Loss of Ignition. The low intensity nonmagnetic fraction (but magnetic at high intensity) weighed 52.14 g. Bulk chemistry of this fraction was: 44.23% $SiO_2$, 27.24% $Al_2O_3$, 11.58% $Fe_2O_3$, 1.03% CaO, 1.27% MgO, 2.87% $K_2O$, and 0.25% $Na_2O$.

Flotation was next employed to separate the unburned carbon. Fuel oil (No. 2) at a dosage of 1.32 g was added to the slurry and thoroughly stirred to coat the unburned carbon particles to provide a hydrophobic surface. After the addition of Dowfroth ® 250 (0.31 g), air was introduced in a flotation machine. Unburned carbon, attached to the air bubbles, was collected in the froth phase. This fraction was filtered, dried, and weighed (71.03 g). Chemical analysis showed that this fraction contained 80.21% carbon (81.20% Loss of Ignition) and 2.88% sulfur. The density was 1.855 $g/cm^3$. After evaporating the adsorbed oil at 250° C., the unburned carbon showed a 24% adsorption activity in a standard molasses test as compared with that of highly activated carbon.

The residual slurry contained the cleaned fly ash, primarily the silicate spheres and irregular shaped silicates. After filtering and drying procedures, the cleaned fly ash weighed 485.48 g. The density of this fraction was 2.250 $g/cm^3$, and the average particle size was 12 micrometers. The chemical composition was: 59.30 $SiO_2$, 1.48% $TiO_2$, 29.41% $Al_2O_3$, 0.01% $Cr_2O_3$, 3.85% $Fe_2O_3$, 1.01% CaO, 1.18% MgO, 0.02% MnO, 0.40% $Na_2O$, 2.91% $K_2O$, 0.03% S, 0.21% $P_2O_5$, and 0.20% Loss of Ignition.

What is claimed is:

1. A wet process for fly ash beneficiation comprising the steps of:

a) mixing a fly ash material having cenospheres with a dispersant and water to form a primary slurry from about 5 to about 35 percent by weight fly ash material;

b) allowing the primary slurry to settle and removing the cenospheres floating in the primary slurry for separating and collecting the cenospheres having a density below about 1.0 g/cc from the primary slurry to form a secondary slurry;

c) adding a constituent soluble in the water to form a water solution between 1.0 g/cc and about 1.6 g/cc and allowing particles of the fly ash material with a density between 1.0 g/cc and about 1.6 g/cc to float in the secondary slurry and thereafter removing and collecting these particles from the secondary slurry to form a tertiary slurry;

d) separating and collecting magnetic materials from the tertiary slurry by imposing a magnetic field from about 100 gauss to about 10 kilogauss and removing the magnetic materials to form a fourth slurry;

e) adding from about 0.5 to about 10 pounds of an oil having a carbon chain greater than octane per ton of fly ash material and a frothing agent to the fourth slurry, whereby the oil will coat remaining unburned carbon in the fourth slurry to form hydrophobic carbon particles;

f) introducing air into the fourth slurry to carry the hydrophobic carbon particles to a frothy layer; and g) removing and collecting the hydrophobic carbon particles from the frothy layer; and h) collecting from the carbon depleted slurry the remaining fly ash material by filtering the carbon depleted slurry.

2. The process of claim 1 wherein step d) further comprises a two part step of first subjecting the tertiary slurry to a high intensity magnetic field from about 1 to about 10 kilogauss for separating both highly magnetic materials and weakly magnetic materials and collecting the highly and weakly magnetic materials and thereafter subjecting the collected highly and weakly magnetic materials to a low intensity magnetic field from about 100 gauss to about 500 gauss for removing and collecting the highly magnetic materials.

3. The process of claim 1 wherein the constituent of step c) is selected from the group consisting of iodine, bromide, and sulfate salts.

4. The process of claim 1 wherein step c) is repeated for sequentially separating materials of sequentially increasing densities out of the secondary slurry.

5. The process of claim 1 wherein the primary slurry of step a) is formed from 10% to 30% by weight fly ash material.

6. The process of claim 1 wherein the dispersant is added to the primary slurry in a concentration of from about 0.01 to about 4 pounds per ton of fly ash material.

7. The process of claim 1 wherein the dispersant is selected from the group consisting of silicates, phosphates, polycrylic acids, ligno sulfonates and mixtures thereof.

8. The process of claim 1 wherein the dispersant is selected from the group consisting of sodium silicates, sodium tripolyphosphate and mixtures thereof.

9. The process of claim 1 wherein step d) comprises separating a highly magnetic material fraction from the tertiary slurry by subjecting the tertiary slurry to a magnetic field from about 100 to about 500 gauss.

10. The process of claim 1 wherein step d) comprises separating a highly magnetic material fraction from the tertiary slurry by subjecting the tertiary slurry to a magnetic field from about 200 to about 400 gauss.

11. The process of claim 1 wherein step d) comprises separating a highly magnetic material fraction from the tertiary slurry by subjecting the tertiary slurry to a magnetic field from about 250 to about 350 gauss.

12. A wet process for fly ash beneficiation comprising the steps of:

a) mixing a primary slurry of a fly ash material having cenospheres with water and a dispersant selected from the group consisting of silicate phosphates, polyacrylic acids, ligno sulfonates and mixtures thereof;

b) allowing the primary slurry to settle and removing the cenospheres floating in the primary slurry thereof for separating the cenospheres having a density below about 1.0 g/cc from the primary slurry to form a secondary slurry;

c) adding an alkali halide or sulfate salt to said secondary slurry to increase the density of said secondary slurry and subjecting said increased density secondary slurry to gravity flotation which results in the removal of a second fraction of materials having a greater density than said secondary slurry increased density to form a tertiary slurry;

d) removing a magnetic fraction of fly ash material by running the tertiary slurry through a magnetic separator at a magnetic field strength of from about 1 to about 5 kilogauss to form a fourth slurry;

e) collecting the magnetic fraction from the tertiary slurry and further separating highly magnetic materials from weakly magnetic materials by subjecting the magnetic fraction to a magnetic field from about 100 gauss to about 500 gauss;

f) removing unburned carbon from the fourth slurry by:

i) adding an effective amount from about 0.5 to about 10 pounds of a collection composition per ton of fly ash material suitable for forming hydrophobic carbon particles in the fourth slurry;

ii) adding a frothing agent to the fourth slurry;

iii) introducing air into the fourth slurry for frothing the fourth slurry carrying the hydrophobic carbon particles to the surface; and iv) collecting the hydrophobic carbon particles from the fourth slurry to form a fifth slurry; and g) collecting the remaining fraction of fly ash material comprising silicate spheres and other silicates from the fifth slurry.

13. The process of claim 12 wherein the density of step c) is increased to from about 1.3 to about 1.4.

14. The process of claim 12 wherein the amount of dispersant added is from about 0.2 to about 2 pound per ton of fly ash material.

15. The process of claim 14 wherein the dispersant is selected from the group consisting of silicates, phosphates, polycrylic acids, ligno sulfonates and mixtures thereof.

16. The process of claim 15 wherein the dispersant is selected from the group consisting of sodium silicates, sodium tripolyphosphate and mixtures thereof.

17. The process of claim 12 wherein the highly magnetic material of step e) is collected by subjecting the magnetic fraction to a magnetic field of from about 200 to 400 gauss.

18. The process of claim 12 wherein the highly magnetic material of step e) is collected by subjecting the magnetic fraction to a magnetic field of from about 250 to 350 gauss.

19. The process of claim 12 wherein the collection composition added is the amount from about 0.5 to about 5 pounds per ton of fly ash material.

20. The process claim 12 wherein the collection composition added is the amount from about 1 to 4 pounds per ton of fly ash material.

* * * * *